US008864546B1

(12) United States Patent
Capriola

(10) Patent No.: US 8,864,546 B1
(45) Date of Patent: Oct. 21, 2014

(54) ILLUMINATED TOY BUILDING SYSTEM AND METHODS

(76) Inventor: Jon P. Capriola, Sarasota, FL (US)

( * ) Notice: Subject to any disclaimer, the term of this patent is extended or adjusted under 35 U.S.C. 154(b) by 691 days.

(21) Appl. No.: 12/547,183

(22) Filed: Aug. 25, 2009

Related U.S. Application Data

(63) Continuation-in-part of application No. 11/839,444, filed on Aug. 15, 2007, now Pat. No. 7,731,558.

(60) Provisional application No. 61/184,111, filed on Jun. 4, 2009.

(51) Int. Cl.

| | |
|---|---|
| ***A63H 33/04*** | (2006.01) |
| ***A63H 33/08*** | (2006.01) |
| ***H01R 24/00*** | (2011.01) |
| ***F21V 21/005*** | (2006.01) |
| *F21Y 101/02* | (2006.01) |
| *F21V 23/06* | (2006.01) |
| *H01R 103/00* | (2006.01) |

(52) U.S. Cl.

CPC ..... *A63H 33/042* (2013.01); *F21Y 2101/02* (2013.01); *F21V 23/06* (2013.01); *H01R 2103/00* (2013.01)

USPC ..... 446/91; 446/92; 446/124; 446/485; 439/8; 439/13; 439/581; 331/3

(58) Field of Classification Search

CPC ..... A63H 33/04; A63H 33/08; A63H 33/10; H01R 35/00; F21V 19/02

USPC ..... 446/91, 92, 124, 485; 439/8, 13, 581; 331/3

See application file for complete search history.

(56) References Cited

U.S. PATENT DOCUMENTS

| | | | | | |
|---|---|---|---|---|---|
| 750,953 | A | | 2/1904 | Dunfee | |
| 1,552,227 | A | * | 9/1925 | Pacent | 439/669 |
| 1,642,064 | A | * | 9/1927 | Engstrom | 439/669 |
| 2,440,661 | A | * | 4/1948 | Calvin | 439/446 |
| 2,519,933 | A | * | 8/1950 | Rouault | 174/21 JC |
| 2,657,369 | A | * | 10/1953 | Ziemianin, Jr. | 439/669 |
| 2,703,393 | A | * | 3/1955 | Bird | 439/668 |
| 2,731,614 | A | * | 1/1956 | Geib et al. | 439/668 |
| 2,967,267 | A | * | 1/1961 | Harold et al. | 361/730 |
| 3,225,460 | A | * | 12/1965 | Randell et al. | 434/236 |

(Continued)

FOREIGN PATENT DOCUMENTS

| | | |
|---|---|---|
| CN | 2596479 | 12/2003 |
| EP | 1162400 | 12/2001 |
| KR | 101999-0078845 | 11/1999 |

OTHER PUBLICATIONS

PCT International Search Report dated May 27, 2011, entire document.

(Continued)

*Primary Examiner* — Gene Kim
*Assistant Examiner* — Alexander Niconovich
(74) *Attorney, Agent, or Firm* — Allen, Dyer, Doppelt et al.

(57) ABSTRACT

A building block set comprises a plurality of transparent blocks each having a hollow internal cavity with a light source fitted within each cavity and first and second electrically conductive connectors extending through each block and into the internal cavity with a circuit within the cavity for illuminating the light in response to an electronic input to either connector.

26 Claims, 12 Drawing Sheets

(56) References Cited

U.S. PATENT DOCUMENTS

| | | | | | |
|---|---|---|---|---|---|
| 3,237,341 | A | * | 3/1966 | Janning | 446/91 |
| 3,289,149 | A | | 11/1966 | Pawloski | |
| 3,418,438 | A | * | 12/1968 | Nevin | 200/51.1 |
| 3,447,249 | A | * | 6/1969 | Greger | 434/224 |
| 3,484,984 | A | * | 12/1969 | Fischer | 446/91 |
| 3,553,883 | A | * | 1/1971 | Fischer | 446/91 |
| 3,576,936 | A | * | 5/1971 | Fischer | 434/224 |
| 3,589,056 | A | * | 6/1971 | Glass et al. | 446/91 |
| 3,626,360 | A | * | 12/1971 | Cole | 439/669 |
| 3,696,548 | A | * | 10/1972 | Teller | 446/91 |
| 4,096,379 | A | * | 6/1978 | Taylor | 362/235 |
| 4,223,377 | A | * | 9/1980 | Williams | 362/145 |
| 4,305,221 | A | * | 12/1981 | Chatani | 446/121 |
| 4,306,373 | A | * | 12/1981 | Chatani et al. | 446/121 |
| 4,423,465 | A | * | 12/1983 | Teng-Ching et al. | 361/730 |
| 4,509,929 | A | * | 4/1985 | Zawitz | 446/102 |
| 4,532,579 | A | * | 7/1985 | Merryman | 362/239 |
| 4,552,541 | A | * | 11/1985 | Bolli | 446/91 |
| 4,667,277 | A | * | 5/1987 | Hanchar | 362/249.01 |
| 4,754,380 | A | * | 6/1988 | Wang | 362/244 |
| 4,869,701 | A | * | 9/1989 | Kawai et al. | 446/91 |
| 4,915,666 | A | * | 4/1990 | Maleyko | 446/242 |
| 4,969,282 | A | * | 11/1990 | Eberhart | 40/545 |
| 4,978,306 | A | * | 12/1990 | Robb | 439/8 |
| 5,018,980 | A | * | 5/1991 | Robb | 439/8 |
| 5,020,253 | A | * | 6/1991 | Lie et al. | 40/576 |
| 5,241,875 | A | * | 9/1993 | Kochanneck | 74/490.03 |
| 5,378,552 | A | * | 1/1995 | Dixon, Jr. | 429/91 |
| 5,409,403 | A | | 4/1995 | Falossi et al. | |
| 5,445,552 | A | * | 8/1995 | Hine | 446/477 |
| 5,496,657 | A | * | 3/1996 | Dixon, Jr. | 429/62 |
| 5,778,579 | A | * | 7/1998 | Yuen | 40/564 |
| 5,779,515 | A | * | 7/1998 | Chung | 446/90 |
| 5,848,503 | A | * | 12/1998 | Toft et al. | 52/173.1 |
| 6,019,486 | A | * | 2/2000 | Stewart, Jr. | 362/362 |
| 6,062,937 | A | * | 5/2000 | Kikuchi | 446/91 |
| 6,241,371 | B1 | * | 6/2001 | Dai | 362/500 |
| 6,443,796 | B1 | * | 9/2002 | Shackelford | 446/91 |
| 6,524,159 | B1 | * | 2/2003 | Kawarizadeh | 446/397 |
| 6,557,282 | B1 | * | 5/2003 | Cleaver | 40/541 |
| 6,585,553 | B1 | * | 7/2003 | Fetridge et al. | 446/91 |
| 6,679,751 | B1 | * | 1/2004 | Maxwell et al. | 446/91 |
| 6,805,605 | B2 | * | 10/2004 | Reining et al. | 446/91 |
| 7,080,927 | B2 | * | 7/2006 | Feuerborn et al. | 362/368 |
| 7,255,624 | B2 | * | 8/2007 | Daftari | 446/92 |
| 7,290,922 | B2 | * | 11/2007 | Scalfi | 362/647 |
| 7,322,873 | B2 | * | 1/2008 | Rosen et al. | 446/91 |
| 7,507,136 | B2 | * | 3/2009 | Patton | 446/92 |
| 7,731,558 | B2 | * | 6/2010 | Capriola | 446/91 |
| 7,846,002 | B1 | * | 12/2010 | Mikesell et al. | 446/91 |
| 7,854,614 | B2 | * | 12/2010 | Robb | 439/8 |
| 7,938,562 | B2 | * | 5/2011 | Ivey et al. | 362/276 |
| 7,966,756 | B1 | * | 6/2011 | Stafford | 40/544 |
| 8,118,447 | B2 | * | 2/2012 | Simon et al. | 362/235 |
| 8,376,756 | B2 | * | 2/2013 | Robb | 439/8 |
| 8,382,323 | B2 | * | 2/2013 | Robb | 362/249.02 |
| 2002/0115373 | A1 | * | 8/2002 | Lazerman | 446/85 |
| 2003/0040250 | A1 | * | 2/2003 | Yim et al. | 446/91 |
| 2003/0148700 | A1 | * | 8/2003 | Arlinsky et al. | 446/91 |
| 2004/0018473 | A1 | * | 1/2004 | Tusacciu | 434/73 |
| 2004/0185745 | A1 | * | 9/2004 | Reining et al. | 446/91 |
| 2005/0024855 | A1 | * | 2/2005 | Ruiz et al. | 362/145 |
| 2006/0084357 | A1 | * | 4/2006 | Rosen et al. | 446/91 |
| 2006/0134978 | A1 | * | 6/2006 | Rosen et al. | 439/581 |
| 2007/0184722 | A1 | * | 8/2007 | Doherty | 439/638 |
| 2008/0139040 | A1 | * | 6/2008 | Hsu et al. | 439/419 |
| 2008/0139077 | A1 | * | 6/2008 | Patton | 446/92 |
| 2008/0160875 | A1 | * | 7/2008 | Leicht | 446/124 |
| 2008/0198599 | A1 | * | 8/2008 | Lai | 362/252 |
| 2009/0154883 | A1 | * | 6/2009 | Robb | 385/56 |
| 2011/0151743 | A1 | * | 6/2011 | Munch et al. | 446/91 |

OTHER PUBLICATIONS

Inter Partes Review of U.S. Patent No. 7,731,558, Petition A filed with the US Patent and Trademark Office on Jan. 23, 2013.

Inter Partes Review of U.S. Patent No. 7,731,558, Petition B filed with the US Patent and Trademark Office on Jan. 23, 2013.

US Patent Trial and Appeal Board, Final Written Decision on La Industries LLC and Capriola Corporation, Case No. IPR2013-00120 dated Jun. 26, 2014.

* cited by examiner

ILLUMINATED TOY BUILDING SYSTEM AND METHODS

CROSS-REFERENCE TO RELATED APPLICATIONS

This application is a continuation-in-part of application Ser. No. 11/839,444 filed on Aug. 15, 2007 and also claims priority to Provisional Application Ser. No. 61/184,111 filed on Jun. 4, 2009. The entirety of both are incorporated herein by reference.

STATEMENT REGARDING FEDERALLY SPONSORED RESEARCH AND DEVELOPMENT

Not Applicable.

FIELD OF THE INVENTION

This invention relates to building block systems and methods and more particularly to illuminated building block systems and methods.

BACKGROUND OF THE INVENTION

Building blocks have been around for generations, and allow children to use their imagination to create a variety of structures. Building blocks have come in many different structural arrangements. Originally, blocks did not interconnect but were merely placed on top of one another to build structures. Later, interconnected blocks such as those sold under the LEGO trademark, were developed that allowed children to create interconnected structures.

Children also enjoy playing with toys with brightly colored lights. Products exist that illuminate plastic members that children can use to create a variety of designs. However, these products typically only permit the creation of two-dimensional designs and pictures.

SUMMARY OF THE INVENTION

The present invention provides a building block system using colored lights that can be interconnected to make a variety of multi-colored, three-dimensional shapes.

In particular, the building block system and method of the present invention employs a variety of building block shapes each of which is preferably formed of a transparent body, and with each building block having at least two electrically conductive connectors, at least one of which is a male connector and at least one other is a female connector. Electrical conductors traverse each body from each connector to the other, with a light emitting diode (LED) connected across each connector. A power source applied to one of the connectors of one of the building blocks permits the LED in that block or any other connected block to be illuminated.

Each male connector is dimensioned for insertion into each female connector to provide a removable and well secured mechanical and electrical connection between adjoining building blocks. In a preferred arrangement, each body is generally transparent so as to transmit light outwardly through the body. Although not limited to such, the building blocks preferably include at least the following shapes: rectangles; cylinders; cylinders with one or more 90° bends; a generally "Y" configuration; and the form of a wheel. A wide variety of other shapes may also be used. Preferably, all of the blocks have a common dimension. Each male and female connector associated with each block allows electric current to illuminate that single block, or to pass electric current from one building block to the next, or allow a block to be connected directly into a power source. As each additional building block is connected, electric current from a power source is transferred from building block to building block via the mechanically interconnected male and female connectors.

A variety of power sources may be used. In one embodiment, the external power source comprises a power base container like that disclosed in the above-identified provisional application and described below. The container holds direct current batteries that are electrically connected through the container with corresponding male or female connectors to one or more of the blocks in a manner which permits the blocks to be stacked upon the top surface of the container. Additionally or in the alternative, a conductor cable may be interconnected with the container with means permitting the various illuminated blocks to be attached thereto. In addition to storage for batteries to power the illuminated blocks, the power base version of the container includes an internal storage area for the blocks.

The present invention is designed to challenge a child's mental acuity for building different and interesting lighted structures in a safe environment. Preferably, the LEDs utilized in the building blocks are of different colors, to further provide stimulation to a child's imagination. Suitably, the blocks are fabricated of high impact plastic, and the level of electricity used is small so as to not create any potential for a shock hazard.

Because each block is capable of illumination without being interconnected with another block, a plurality of individual blocks may be installed upon a platform having appropriate connectors.

In a preferred form, each of the illuminated building blocks is a generally transparent body having an internal light source, e.g. an LED, operable into an illuminated state in response to an electronic input. Male and female connectors are fitted into respective first and second openings through the transparent body. Circuit means are provided within the transparent body coupled with the internal light source and with both the male and female connectors in order to operate the internal light source in response to an electronic input to either the male connector or the female connector, or both. In the preferred form, the male connector of a first block extends through a barrel portion of the transparent body that terminates in a first opening dimensioned to fit within a second opening of a second block so that the male connector of the first block can be mechanically and electrically interconnected with the female connector of the second block. Preferably, the block set uses LEDs of different colors. A colored indicator on each block corresponds to the color of the internal LED for that block.

Further details of the invention will be understood from a review of the accompanying drawings and the following detailed description.

DETAILED DESCRIPTION OF THE PREFERRED EMBODIMENTS

Figure 1:
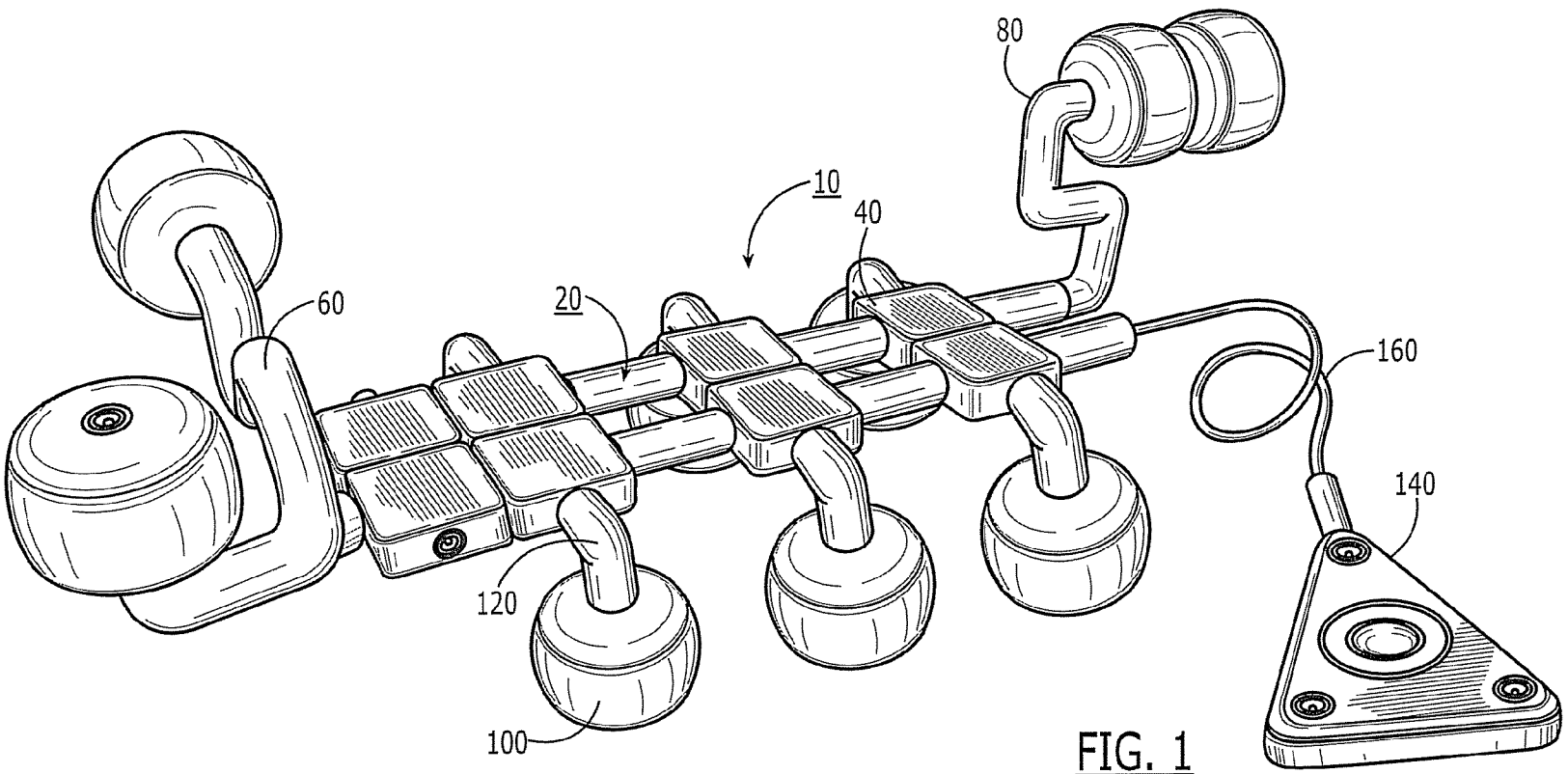
FIG. 1 is a perspective view of a construction utilizing the illuminated building block system of the present invention.

The present invention will now be described with reference to the drawing.

FIG. 1 illustrates a whimsical construction made from the building blocks of the present invention as described in greater detail below. The construction shown in FIG. 1 may, in the mind of a child, comprise a mechanical dog, an insect, an alien or perhaps even a space station in which most of the building blocks are capable of being illuminated with internally-mounted LEDs of different colors. The construction, referred to with reference numeral 10, includes cylindrical blocks 20 described below in greater detail with reference to FIGS. 2, 3 and 6; rectangular blocks 40 (FIGS. 4, 5 and 6); generally "Y"-shaped blocks 60 (FIGS. 7 and 8); generally "U"-shaped blocks 80 (FIG. 9); and generally wheel-shaped blocks 100 (FIG. 10). Generally "L"-shaped building blocks 120 may also be provided as shown in FIG. 1 and in FIG. 3 of application Ser. No. 11/839,444, incorporated by reference. The construction 10 is powered through power cord 160 by batteries contained within a power unit 140.

Figure 2:
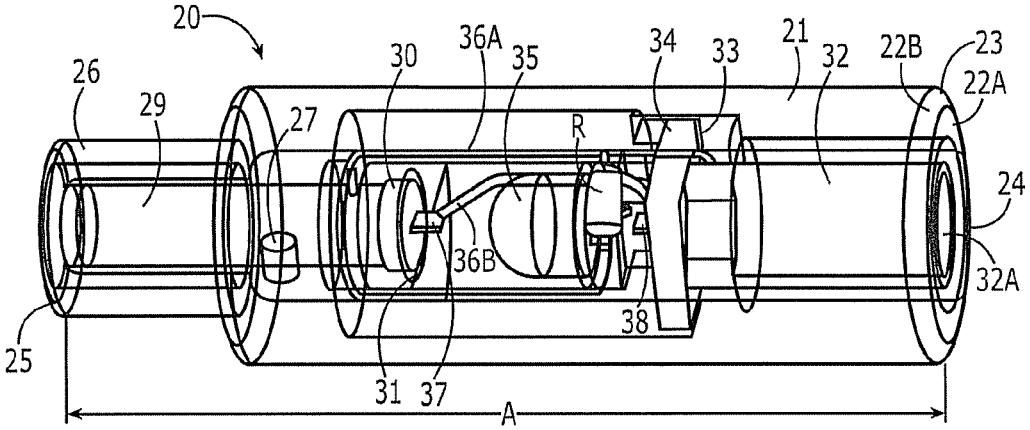
FIG. 2 is a side view of the cylindrical block 20 shown in FIG. 1.

The cylindrical building blocks 20 will now be described with reference to FIGS. 2 and 3. Each cylindrical building block 20 comprises a transparent body 21 formed of opposing halves 22A and 22B, separated by a seam 23, the two halves being held firmly together with an index pin 27 (FIG. 2) fitted into index hole 28 (FIG. 3) and with the two halves sonically welded together. The cylindrical body 21 forms opposing hollow ends 24, 25 with a barrel 26 extending outwardly from the body 21 to the end 25. While the barrel 26 shown in FIGS. 2 and 3 is depicted as having a circular cross-sectional shape, it will be understood that other cross-sectional shapes are suitable, so long as the shape corresponds to the shape of the opening at the end corresponding to the female connector of every other block, for example end 24 shown in FIGS. 2 and 3.

Figure 11:
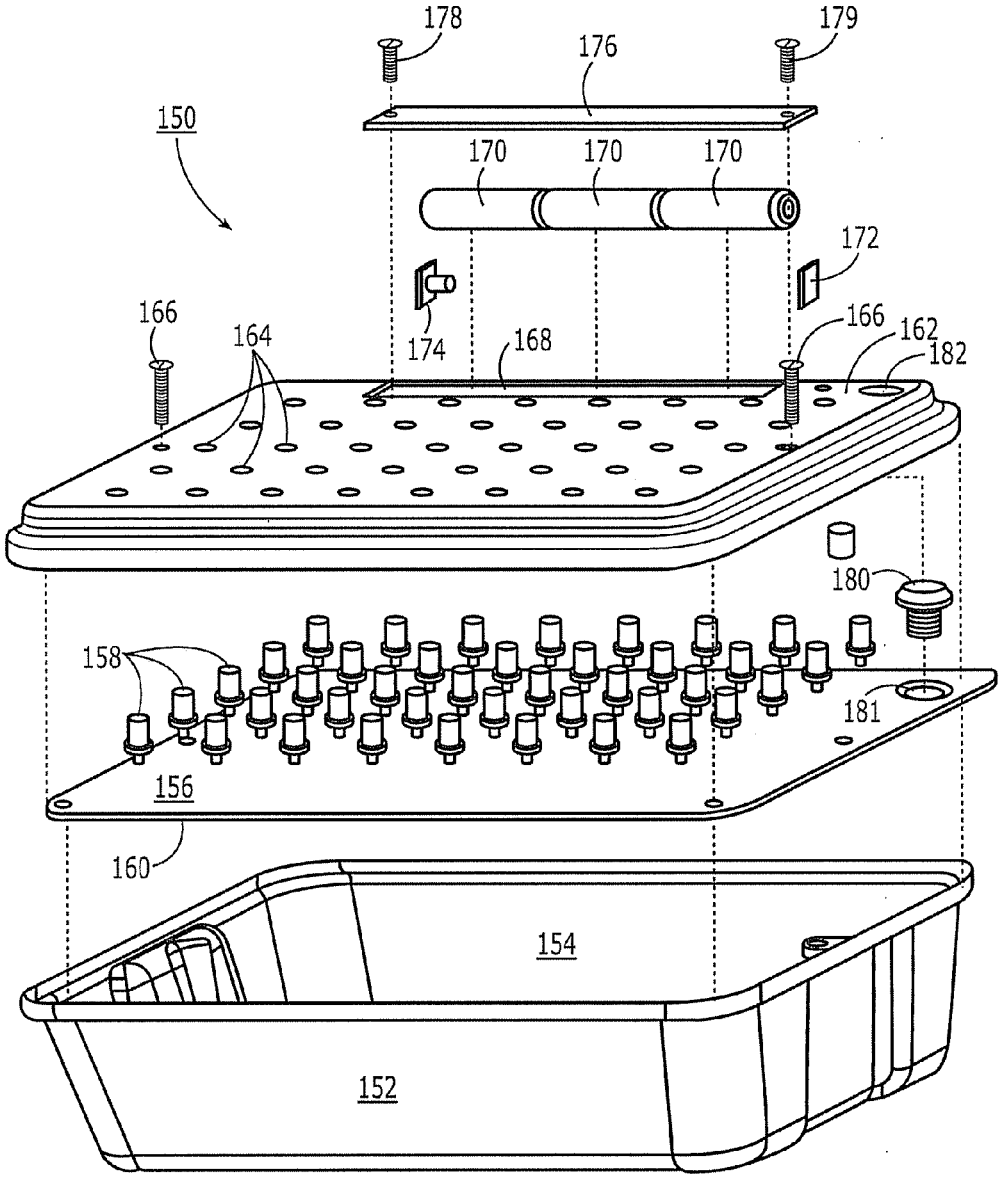
FIG. 11 is an exploded perspective view of a power base 150 in accordance with the present invention.
Figure 12:
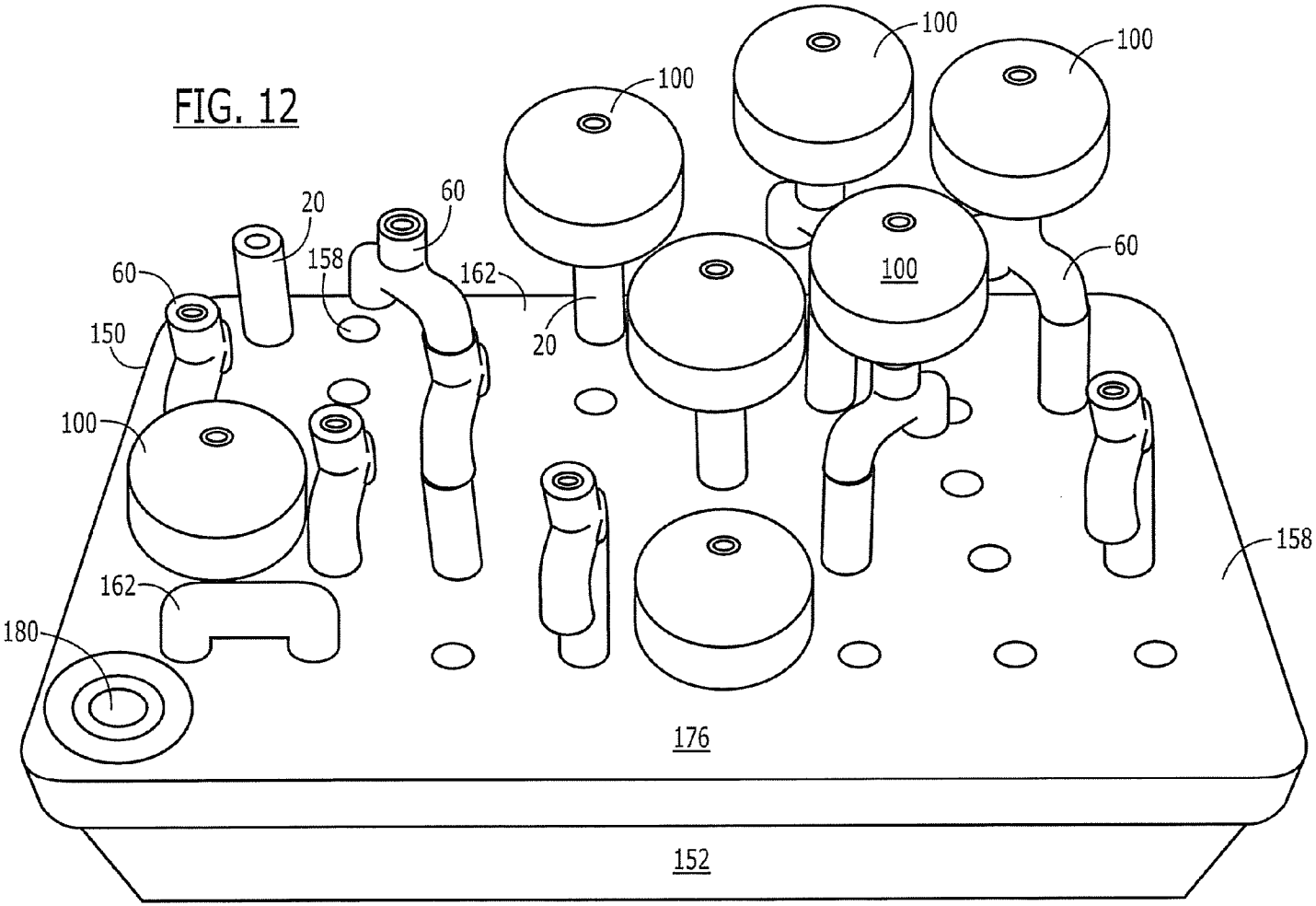
FIG. 12 is a perspective view of the assembled power base 150 of FIG. 11, interconnected with various building blocks shown in FIGS. 1-10.
Figure 14:
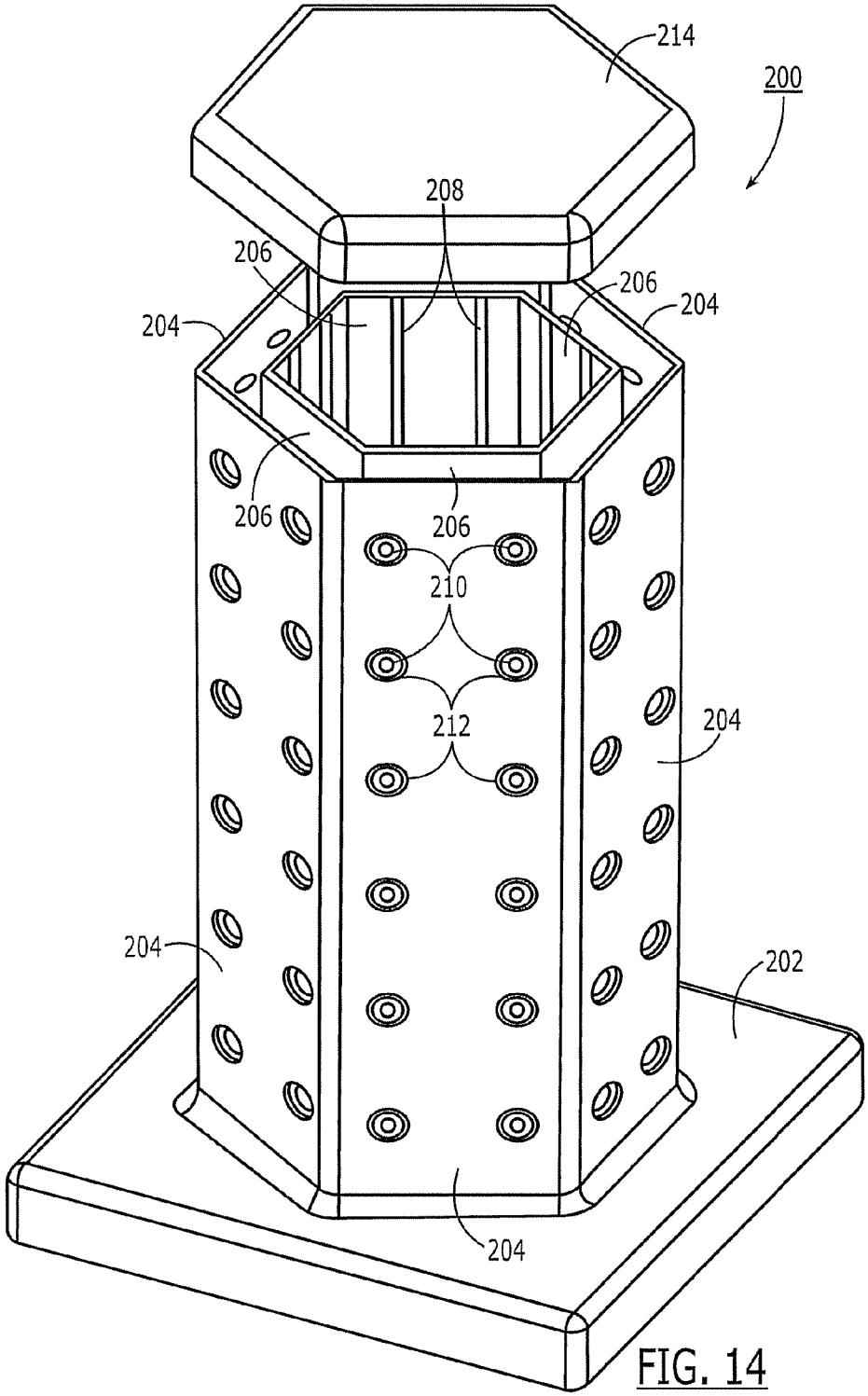
FIG. 14 is a perspective view of a vertical power tower in accordance with the present invention.

Each cylindrical block 20 further comprises a male connector 29 extending through the male cavity MC of the barrel 26 and available through the hollow end 25 for mechanical and electrical interconnection to an external current source, such as a power unit 140 (FIG. 1) or power base 150 of FIGS. 11 and 12 or the power tower 200 of FIG. 14. Alternatively, the male connector 29 is dimensioned to mechanically and electrically fit within a female connector of a second block, as will be better understood from the discussion set out below regarding FIGS. 6 and 15. In the same manner, the female connector 32 extends through the female cavity FC and adjacent the end 24. The second opening at the end 24 is dimensioned to receive a barrel from a second block so that a male connector of the second block can be interconnected with the female connector 32. The respective connectors 29, 32 have rear conductive posts 37, 38, as seen in FIG. 3. The male connector 29 includes a non-conductive collar 30 which fits into a holding recess 31 of body 21 and the female connector 32 likewise includes a non-conductive collar 34 that fits within a recess 33.

Figure 3:
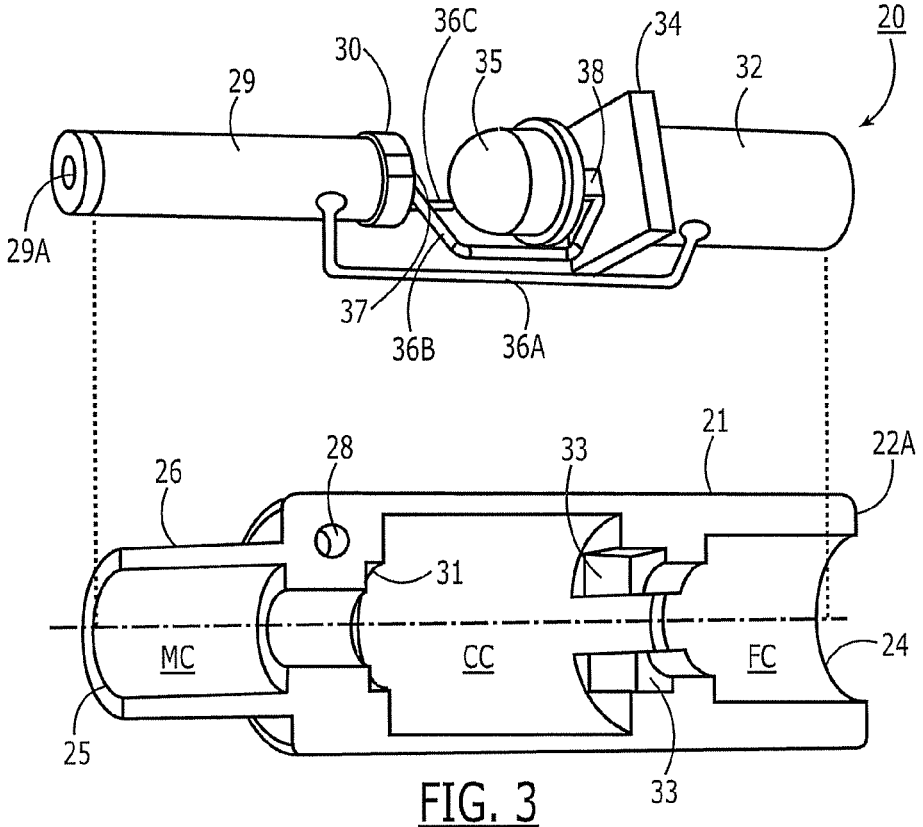
FIG. 3 is an exploded view of portions of the cylindrical block 20 shown in FIG. 2.

As is illustrated in the bottom portion of FIG. 3, the molded halves 22A and 22B of the cylindrical body 21 define the male cavity MC, the female cavity FC and a central cavity CC. Each cylindrical building block 20 is provided with a LED 35 that fits within the central cavity CC, and circuit means 36A, 36B and 36C connected so that the LED 35 is electrically connected across the inner and outer conductive portions of the male conductor 29; likewise, the circuit means 36A-C are configured so that the inner and outer conductive portions of the female connector 32 are wired with the LED 35 across those two portions of that connector. A resistor R provides a voltage drop for the LED 35. (See FIG. 15).

Figure 4:
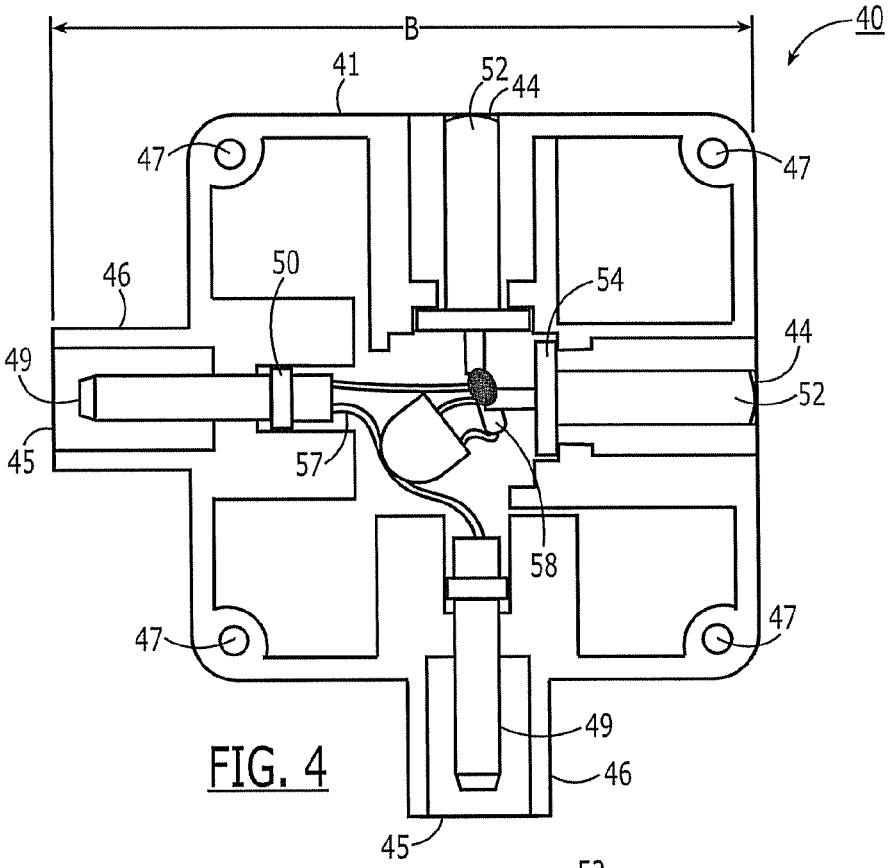
FIG. 4 is a top plan view of the rectangular block 40 shown in FIG. 1.
Figure 5:
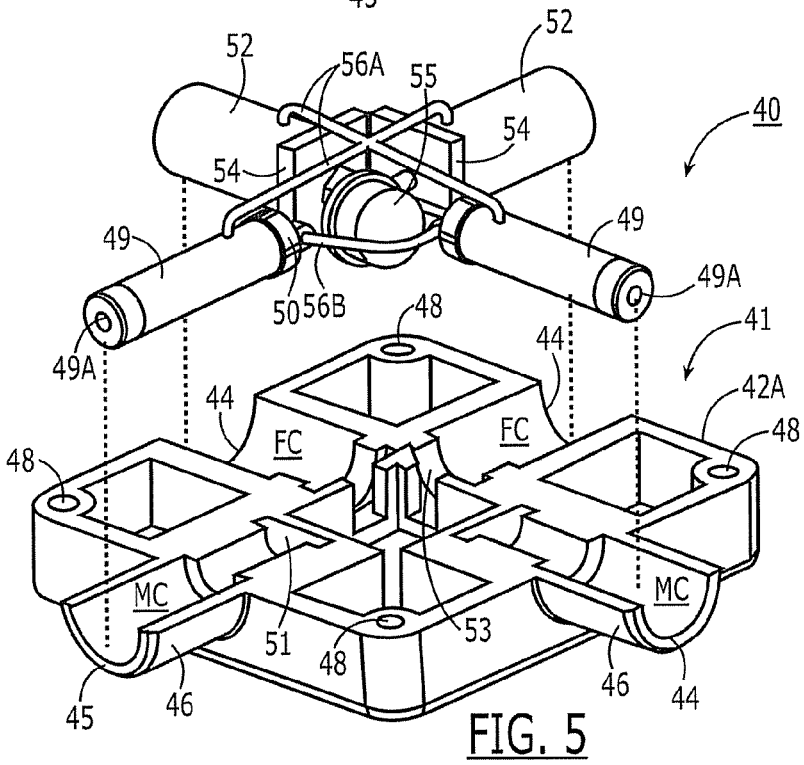
FIG. 5 is an exploded perspective view of a portion of the rectangular block 40 shown in FIG. 4.

FIGS. 4 and 5 illustrate the details of the rectangular block 40 shown in FIG. 1. Each rectangular building block 40 comprises a transparent body 41 (e.g. a square body shown in FIG. 4) formed of opposing halves 42A (FIG. 5) and 42B (FIG. 6), the two halves being held together with index pins 47 fitted into index holes 48 and sonically welded together. The rectangular body 41 has two sets of opposing hollow ends 44, 45 with barrels 46 extending outwardly from the body 41 to the ends 45. Each rectangular block 40 further comprises two male connectors 49 extending through a respective barrel 46 and available through the corresponding open end 45 for mechanical and electrical interconnection to an external current source, such as power unit 140, the power base 150 (FIGS. 11 and 12) or the power tower 200 (FIG. 14). Alternatively, the male connector 49 may be interconnected with a female connector of an adjacent block as is described below with reference to FIG. 6.

The respective connectors 49, 52 have rear conductive posts 57, 58 (FIG. 4). Each male connector 49 includes a non-conductive collar 50 that fits into a holding recess 51, and each female connector 52 likewise includes a non-conductive collar 54 that fits within a corresponding recess 53.

Each rectangular building block 40 is provided with an internal LED 55 and circuit means 56A, 56B and 56C connected so that the LED 55 is electrically connected across the internal and external conductive portions of all four male and female conductors 49, 52. A resistor (not shown) provides a voltage drop across the LED 55.

As will be appreciated from a review of FIG. 5, one male connector 49 is axially aligned with a corresponding female connector 52 on the opposite side of the rectangular body 41 and the second male connector 49 is likewise axially aligned across the rectangular body 41 with the second female connector 52. The male connectors 49 fit within respective male cavities MC and the female cavities fit within respective female cavities FC.

Figure 6:
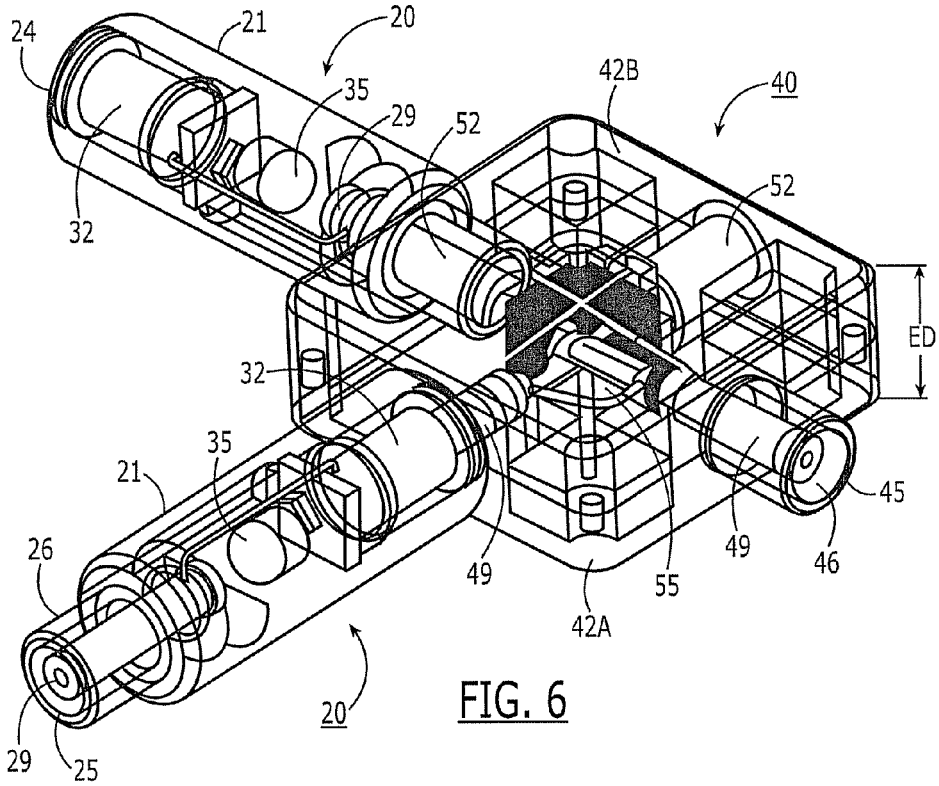
FIG. 6 is a perspective view of two cylindrical blocks 20 as shown in FIGS. 2 and 3 interconnected with a rectangular block 40 as shown in FIGS. 4 and 5.

The method by which the building blocks may be interconnected together is depicted in FIG. 6, where two cylindrical blocks 20 are shown interconnected to a single rectangular block 40. Note that the cylindrical block 20 shown in the upper left hand portion of FIG. 6 has its male connector 29 interconnected with one of the female connectors 52 of the rectangular block 40. In contrast, the second cylindrical block 20 shown in the bottom left hand portion of FIG. 6 has its female connector 32 interconnected with one of the male connectors 49 of the rectangular block 40. It will of course be appreciated that a power source connected to any one of the available connectors of the cylindrical blocks (e.g., the unconnected male connector 29 in the bottom left hand corner of FIG. 6 or the unconnected female connector 32 in the upper left hand side of FIG. 6) or either of the available connectors of the rectangular block 40 (e.g., unconnected male connector 49 or unconnected female connector 52 on the right hand side of FIG. 6) will provide current to the LEDs 35 of the two cylindrical blocks 20, as well as to the LED 55 of the rectangular block 40.

Figure 7:
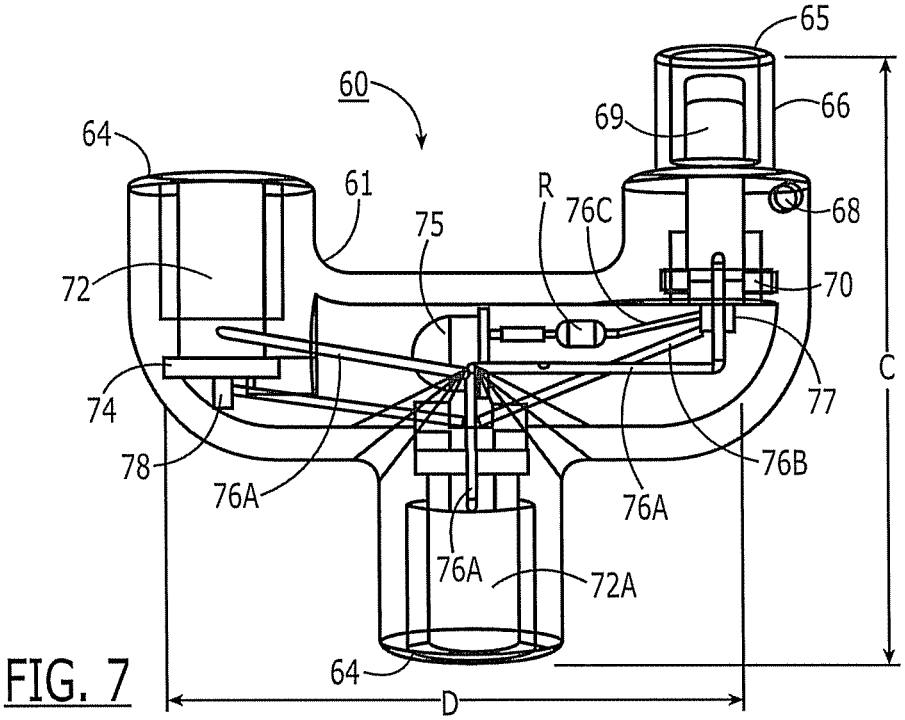
FIG. 7 is a front view of the "Y"-shaped block 60 shown in FIG. 1.
Figure 8:
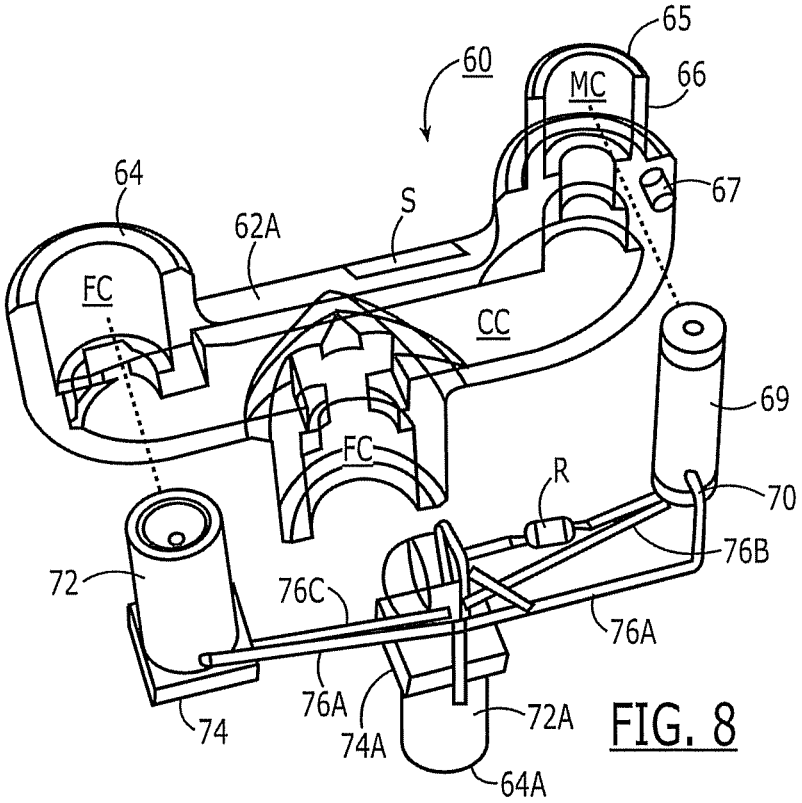
FIG. 8 is an exploded perspective view of a portion of the "Y"-shaped block 60 shown in FIG. 7.

The details of the "Y"-shaped block 60 shown in FIG. 1 will now be described with reference to FIGS. 7 and 8. Each "Y"-shaped building block 60 comprises a transparent body 61 formed of opposing halves 62A and 62B, separated by a seam (not shown), with the two halves 62A and 62B being held firmly together with index pin 67 fitted into an index hole 68 and the two halves sonically welded together. The "Y"-shaped body 61 forms internal hollow ends 64, 65 with a barrel 66 extending outwardly from the body 61 to the end 65. Each "Y"-shaped block 60 further comprises a male connector 69 extending through the male cavity MC and the barrel 66 and is available through the hollow end 65 for mechanical and electrical interconnection to an external current source to energize an LED 75. Alternatively, the male connector 69 is dimensioned to fit within a female connector of a second block, in the manner described above with reference to FIG. 6. The female connector 62 extends through a female cavity FC and to the adjacent end 64. The second opening at the end 64 is dimensioned to receive a barrel from a second block so that a male connector of the second block can be mechanically or electrically interconnected with the female connector 72. The respective connectors 69, 72 include respective rear conductive posts 77, 78 as seen in FIG. 7. The male connector 69 includes a non-conductive collar 70 which fits into a holding recess 71 and the female connector 72 likewise includes a non-conductive collar 74 that fits within recess 73. As is shown in FIGS. 7 and 8, the male and female connectors 69, 72 are positioned at opposing sides of the body 61 and extend outwardly and generally parallel with each other in a first direction away from the body 61. Further, the "Y"-shaped block 60 also includes a second female connector 72A that is positioned along the body 61 generally between the male and female connectors 69, 72 and extends outwardly from the body 61 in a second direction opposite to the first direction. It will of course be appreciated by those skilled in the art that the second female connector 72A may be replaced by a male connector as well.

The generally "U"-shaped building block 80 will now be described with reference to FIG. 9. The building block 80 is formed in a generally "U"-shaped body 81 having male and female connectors 89, 92 positioned at opposing sides of a generally "U"-shaped body 81, with an internal LED 95 and circuitry of the type described above positioned between the two internal ends of the connectors 89, 92. The construction of the "U"-shaped building block 80 is essentially like that of the "Y"-shaped building block 60 shown in FIG. 8, with the exception that there is not a second female connector.

The wheel-shaped building block 100 will now be described with reference to FIG. 10. The building block 100 is formed in a generally wheel-shaped body 101 having a central axis AX, with the body 101 molded so as to define opposing openings 104, 105 with the opening 105 extending from a barrel 106 much like that described above with reference to FIGS. 2-9. The building block 100 includes a male connector 109 and a female connector 112 each of which has a corresponding non-conductive support collar 110, 114. As shown in FIG. 10, the male and female connectors 109, 112 are axially aligned across the wheel-shaped building block 100 along the central axis AX. The male connector 109 extends through a barrel 106 outwardly to open end 105, and the female connector 112 is available for interconnection through opening 104. The building block 100 includes an internal LED 115 and circuitry including conductor 116A to provide current to the LED irrespective of whether the source of the current is the male connector 109 or the female connector 112.

Figure 9:
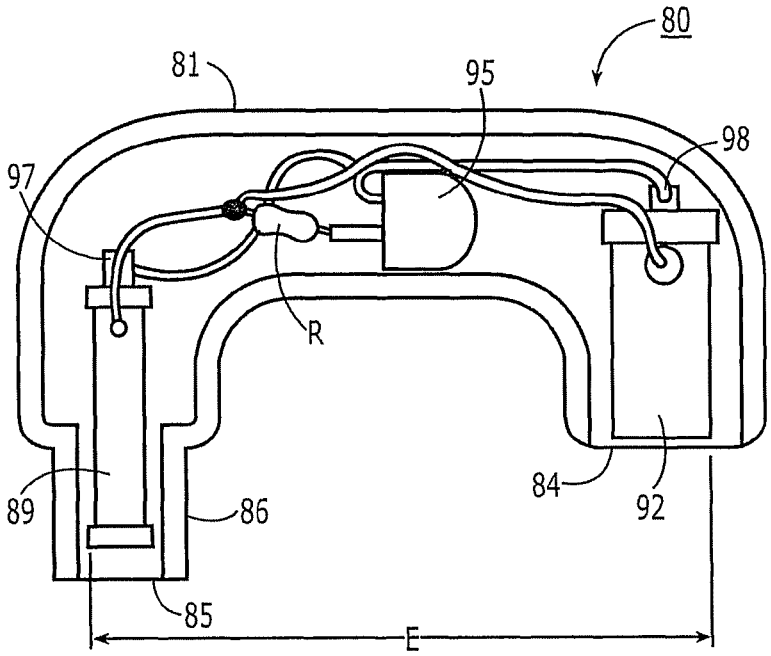
FIG. 9 is a top plan view of the generally "U"-shaped building block 80 shown in FIG. 1.
Figure 10:
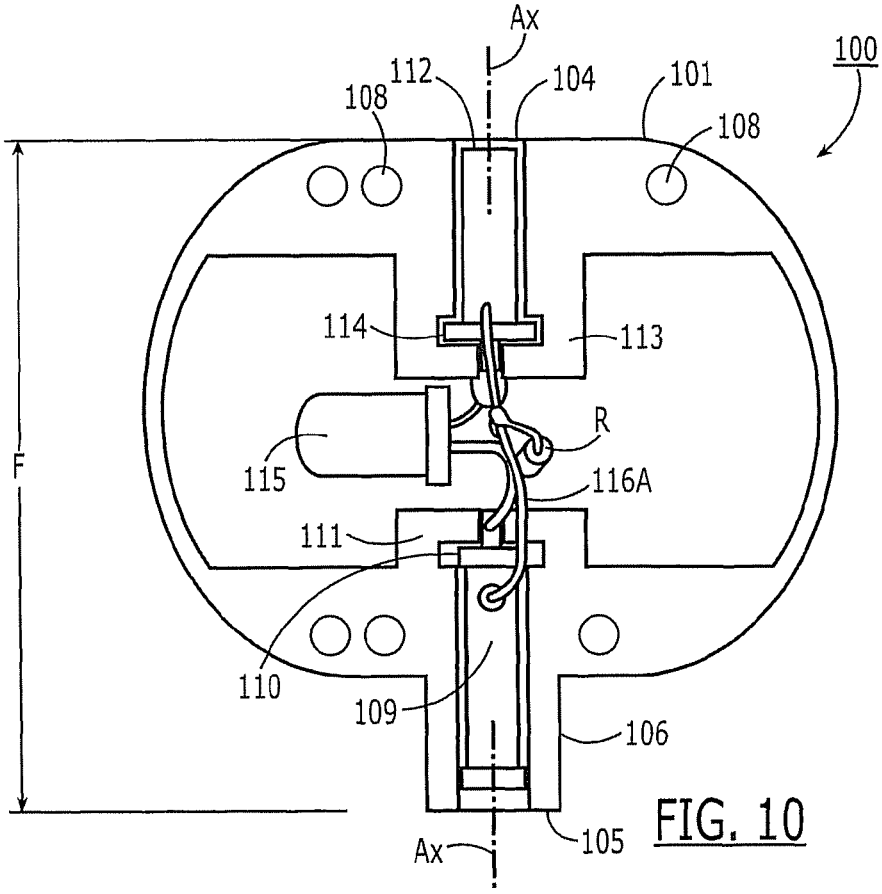
FIG. 10 is a top plan view of the wheel-shaped building block 100 shown in FIG. 1.

Attention is now drawn to FIGS. 2, 4, 7, 9 and 10. In FIG. 2, the overall dimension between the extremities of the male and female connectors 29, 32 is represented by the letter A. With respect to the rectangular block 40 shown in FIG. 4, the overall dimension between the extremities of a first one of the male connectors 49 and a first one of the female connectors 52 is represented by the letter B; it will of course be understood that the same dimension applies as between the second pair of male and female connectors 49, 52 when the body 41 is square. For the "Y"-shaped block 60 depicted in FIG. 7, the dimension between each combination of a male connector 69 and a female connector 72 or 72A, is represented by the letters C and D. In FIG. 9, the overall dimension between the male connector 89 and the female connector 92 is represented by the letter E. In FIG. 10, the overall dimension between the extremities of the male connector 109 and the female connector 112 is represented by the letter F. In accordance with the present invention, the dimensions represented by the letters A, B, C, D, E and F are essentially the same, in order to facilitate an orderly fabrication of multiple block constructions. Further, as shown in FIG. 6, the edgewise dimension ED of the rectangular block 40 between the upper and lower surfaces of the body 41 is the same as the diameter of each cylindrical body 20, 60 and 80. As discussed above, it is also preferable that each of the building blocks, including blocks 20, 40, 60, 80 and 100, be provided with an indication of the blur of the internal LED. By way of example, the color indicator can: be a colored stripe S as shown in FIG. 8.

One form of a power base unit 150 will now be described with reference to FIGS. 11 and 12.

First noting FIG. 11, the unit 150 comprises a storage tray 152 having an internal storage area 154 and an upper plate member 156 having a plurality of connectors 158, for example female connectors, attached to the upper surface of the plate member 156 and coupled via a metallization pattern on a bottom surface 160 of the plate member 156 to a set of batteries 170. A cover member 162 fits over the plate member 156 and to the storage tray 152 via fasteners 166. The cover member 162 includes plural holes 164 in alignment with the connectors 158, so that when the cover member 162 is fitted to the tray 152 and over the plate member 156, the fasteners 158 extend through corresponding holes 164. A battery compartment 168 extends along a side of the cover member 162 and is dimensioned to receive the set of batteries 170 therein, together with opposing negative and positive electrodes 172, 174, respectively. A power switch 180 is coupled to the batteries and to the metallization pattern on the bottom 160 of plate member 156 through aperture 181, with the top of the power switch 180 extending through an opening 182 in the cover member 162. The unit 150 further includes a battery cover plate 176 that is attached to the cover member 162 via fasteners 178, 179. It will be appreciated that a variety of on-off mechanisms may be used, such as a motion sensor, a light sensor or a sound sensor.

Turning now to FIG. 12, the unit 150 is shown assembled and with examples of various blocks described above plugged in to the connectors 158 at the upper surface of the cover member 162. Operation of the power switch 180 will illuminate each of the building blocks 20, 60 and 100 connected through the top surface of the cover member 162, irrespective of whether another block is coupled to each block connected to the unit 150.

Figure 13:
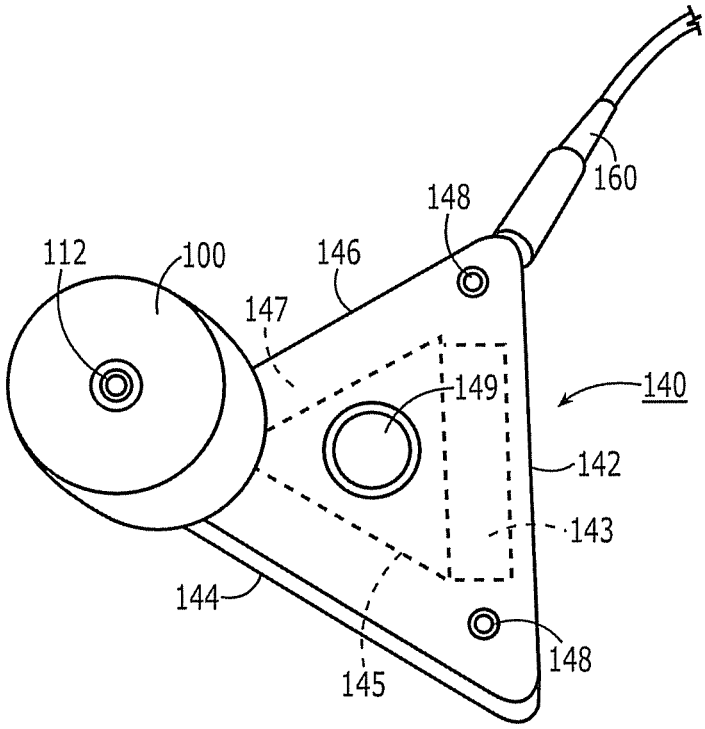
FIG. 13 is a top plan view of the power unit 140 shown in FIG. 1.

FIG. 13 illustrates the power unit 140 shown in FIG. 1. The power unit 140 comprises a plastic body having, in this instance, three sides, 142, 144 and 146. Batteries 143, 145 and 147 are situated within the power unit 140 along the respective sides 142, 145 and 146. Additionally, connectors 148, either male or female, are positioned at the three corners of the power unit 140; any one of the building blocks described above may be interconnected with one of the connectors 148, as the wheel block 100 shown in FIG. 13. Additionally, the power unit 140 may include an output to a power cable 160.

A power tower 200 in accordance with the present invention is show in FIG. 14, and includes a base 202 and an upright tower formed of sides 204, including the specific six-sided structure shown in FIG. 14. An internal construction comprising side walls 206 opposing respective sides 204 includes a metallization pattern 208 along the inside thereof, with connectors 210 attached to the interior members 206 and extending through holes 212 for interconnection with one of the blocks described above. The unit 200 includes an enclosing top 214.

Figure 15:
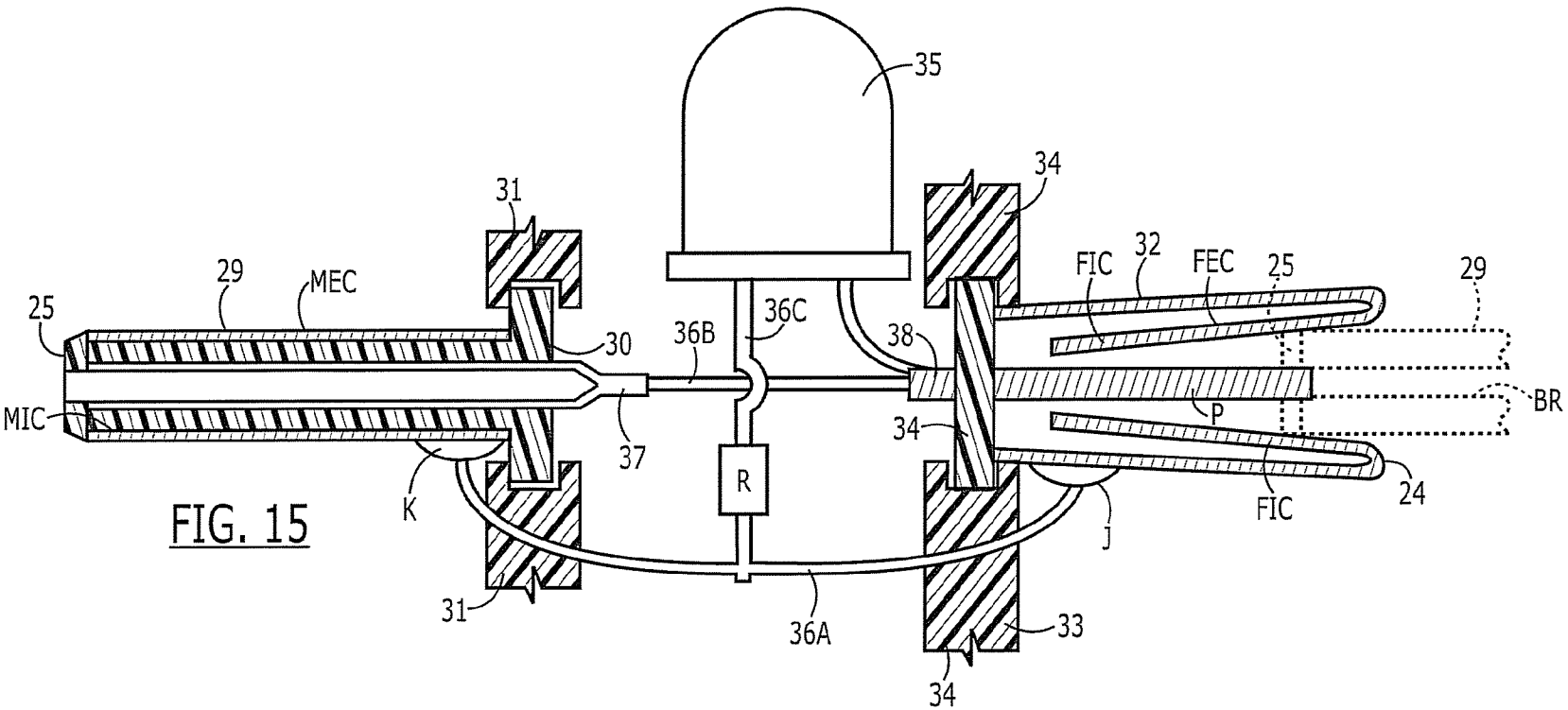
FIG. 15 is a partial cross-section of the male and female connectors and circuit components of one embodiment.

FIG. 15 is a representative cross-sectional illustration of the male and female connectors and the internal circuit components of a building block. The reference numerals in FIG. 15 correspond to the elements of the cylindrical block 20 illustrated in FIGS. 2 and 3. As shown in FIG. 15, the male connector 29 includes an internal conductor MIC and an external conductor MEG, each comprising metallic sleeves. The male internal conductor MIC is electrically connected to the rear conductive post 37. The female connector 32 comprises a central pin P dimensioned to receive the bore BR of a male connector 29 (note the right hand side of FIG. 15). The female connector 32 further comprises an internal conductor FIC and an external conductor FEC. It will thus be understood that when a male connector 29 from a second cylindrical block 20 is inserted into the female connector 32 with the bore BR sliding across the pin P, the internal conductor FIC of the female connector 32 makes a circuit between the male internal conductor MIC so as to complete a circuit with the rear conductive post 38. The female external conductor FEC makes contact with the male external conductor MEG to complete a circuit at post J on the female connector 32, which in turn is connected through circuit line 36A to post K that is electrically connected to the male external conductor MEC of the male connector 29. The rear posts 37, 38 are shorted together with one terminal of the LED 35 through circuit line 36B, with a third circuit line 36C coupled to circuit line 36A through resistor R. It will thus be understood that an application of electronic current through either the male connector 29 or the female connector 32 will result in the illumination of LED 35.

Figure 16:
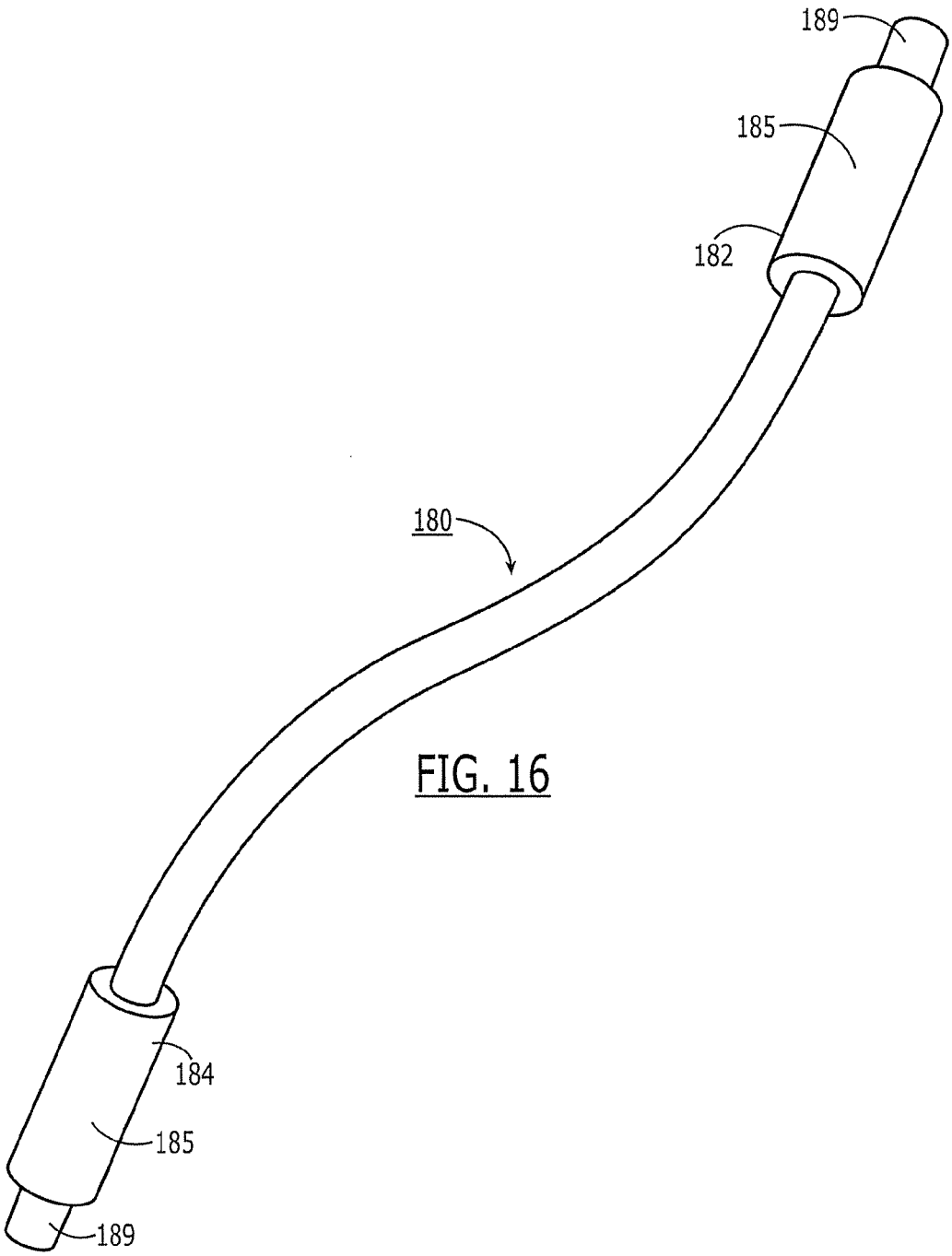
FIG. 16 illustrates a circuit connector cord useful with this invention.

FIG. 16 illustrates another form of a power cord 180 having modified cylindrical bodies 182, 184 at the respective ends of the cable 180, with each of the cylindrical bodies having an LED 185 and a barrel 189 such as that described above with reference to FIGS. 2 and 3 to house a connector, such as connector 29 in FIG. 2, in order that either end of the cable 180 may be connected to one of the power units such as 140 shown in FIG. 13 or the combination unit 150 shown in FIGS. 11 and 12.

There are a significant number of modifications and changes that may be made in the illuminated toy system and its various components described above without departing from the spirit and scope of this invention.

What is claimed is:

1. A building block set having a plurality of building blocks, with at least some of the blocks comprising:

a generally transparent body defining a hollow interior cavity and having first and second cylindrical openings thereinto;

an internal light source within the hollow interior cavity of the transparent body operable into an illuminated state in response to an electrical input;

a non-conductive barrel extending outwardly from the transparent body and coaxial with the first cylindrical opening;

a male electrically conductive connector fitted at least partially into the non-conductive barrel and coaxial therewith;

a female electrically conductive connector extending into the hollow interior cavity coaxially away from the second cylindrical opening; and an electrical circuit within the interior volume of the transparent body electrically coupled with the internal light source and both the male and female connectors for powering the internal light source in response to an electrical input into either electrically conductive connector;

wherein the at least some of the blocks are connectable such that, with the male electrically conductive connector of a first one of the blocks fully inserted into the female electrically conductive connector of a second one of the blocks, the non-conductive barrel of the first one of the blocks will be at least partially seated within the cylindrical opening of the second one of the blocks, and the first one of the blocks and the second one of the blocks are freely rotatable relative to one another about a connection axis therebetween while maintaining electrical contact; and wherein, with the male electrically conductive connector of the first one of the blocks fully inserted into the female electrically conductive connector of the second one of the blocks, the female electrically conductive connector of the second one of the blocks will be, in a radial direction perpendicular to the connection axis, at least partially seated between the non-conductive barrel and the male electrically conductive connector of the first one of the blocks.

2. The building block set of claim 1 wherein the non-conductive outwardly extending barrel surrounding the male connector at the first opening is formed integrally with the transparent body.

3. The building block set recited in claim 1 wherein the male and female connectors are spaced apart and aligned either axially or in parallel across the transparent body.

4. The building block set recited in claim 3 further comprising:

a second male connector;

a second female connector; and wherein the second male connector and the second female connector are spaced apart and aligned with each other across the transparent body.

5. The building block set recited in claim 4 wherein the electrical circuit is also electrically coupled with the second male connector and the second female connector so that the light source is powered in response to an electrical input to any one of the four conductors.

6. The building block set recited in claim 5 wherein the transparent body is rectangular in shape with four sides, and with one of the four connectors positioned along each side.

7. The building block set recited in claim 3 wherein the transparent body is shaped as a cylinder.

8. The building block recited in claim 3 wherein the transparent body is shaped as a wheel having a center axis, with the male and female connectors axially aligned across the transparent body and along the axis.

9. The building block set recited in claim 1 wherein the male connector and the female connector are spaced apart and extend generally parallel in a first direction away from the transparent body.

10. The building block set recited in claim 9 further comprising a third connector positioned generally between and parallel with the male and female connectors and extending in a second direction from the transparent body opposite the first direction, the third connector being either a male or female connector.

11. The building block set recited in claim 1 further comprising:

a container;

a battery within the container; and a container electrical circuit for supplying electrical energy from the battery means to one of the male connector and the female connector.

12. The building block set recited in claim 11 wherein the container electrical circuit comprises a connector mechanically interconnectable with one of the male connector and the female connector.

13. The building block set recited in claim 12 wherein the container comprises an outer surface with the container electrical circuit comprising a connector extending through the outer surface of the container.

14. The building block recited in claim 13 wherein the outer container surface comprises a flat surface having a plurality of connectors, each dimensioned for mechanically interconnecting with one of the male connectors and the female connectors.

15. The building block set recited in claim 1 wherein, with the non-conductive barrel of the first one of the blocks at least partially seated within the second cylindrical opening of the second one of the blocks, the blocks are maintained in a fixed axial alignment about the connection axis.

16. The building block set recited in claim 1 wherein, with the male electrically conductive connector of the first one of the blocks fully inserted into the female electrically conductive connector of the second one of the blocks, the non-conductive barrel of the first one of the blocks will be, in the radial direction, at least partially seated between the cylindrical opening and the female electrically conductive connector of the second one of the blocks.

17. A building block set comprising:

at least one first block having a first shape, the at least one first block including:

a first block body that is at least partially transparent, having a first block hollow interior cavity and defining a first block cylindrical opening extending thereinto;

a first block internal light source fitted within the first block hollow interior cavity;

a first block female electrically conductive connector fitted coaxially with the first block cylindrical opening and operable to illuminate the first block internal light source upon application of an electrical input thereto; and at least one second block having a second shape different from the first shape, the at least one second block including:

a second block body that is at least partially transparent, having a second block hollow interior cavity and defining a second block cylindrical opening extending thereinto;

a second block non-conductive barrel extending outwardly from the second block body and coaxial with the second block cylindrical opening;

a second block internal light source fitted within the second block hollow interior cavity;

a second block male electrically conductive connector fitted at least partially into the second block non-conductive barrel and coaxial therewith and operable to illuminate the second block internal light source upon application of an electrical input thereto;

wherein the first and second blocks are electrically and mechanically connectable along a connection axis at any relative angle of rotation between the first and second block electrically conductive connectors by inserting the second block male electrically conductive connector into the first block female electrically conductive connector and at least a portion of the second block non-conductive barrel into the first block cylindrical opening; and wherein, with the second block male electrically conductive connector fully inserted into the first block female electrically conductive connector, the first block female electrically conductive connector will be, in a radial direction perpendicular to the connection axis, at least partially seated between the second block non-conductive barrel and the second block male electrically conductive connector.

18. The building block set recited in claim 17 wherein the first and second block electrically conductive connectors are each a first connector, and each of the first and second blocks further includes a second electrically conductive connector; and wherein the first connector of each block extends in a direction that is one of coaxially or in parallel with respect to the direction of the second connector of the same block.

19. The building block set recited in claim 18 wherein each first block has a third electrically conductive connector extending through a third portion of the block and into the hollow interior cavity, the third connector also operable to illuminate the first block internal light source upon application of an electrical input thereto.

20. The building block set recited in claim 17 wherein:

each first block is cylindrical in shape; and each second block is rectangular in shape and has an edgewise dimension generally equal to the diameter of each cylindrical first block.

21. The building block set recited in claim 20 wherein each second rectangular block has two male connectors and two female connectors, each female connector axially aligned with a corresponding male connector.

22. The building block set recited in claim 17 further comprising:

a plurality of third blocks of a third shape different from the first and second shapes, each of the third blocks including:

a third block body that is at least partially transparent, having a third block hollow interior cavity and defining a third block cylindrical opening extending thereinto;

a third block non-conductive barrel extending outwardly from the third block body and coaxial with the third block cylindrical opening;

a third block male electrically conductive connector fitted at least partially into the third block non-conductive barrel and coaxial therewith.

23. The building block set recited in claim 22 wherein each of the first, second and third blocks have a common outer dimension.

24. The building block set of claim 17 wherein the second block non-conductive barrel is formed integrally with the second block body.

25. The building block set recited in claim 17 wherein, with at least a portion of the second block non-conductive barrel inserted into the first block cylindrical opening, the first and second blocks are maintained in a fixed axial alignment about the connection axis.

26. The building block set recited in claim 17 wherein, with the second block male electrically conductive connector fully inserted into the first block female electrically conductive connector, the second block non-conductive barrel will be, in the radial direction, at least partially seated between the first block cylindrical opening and the first block female electrically conductive connector.

* * * * *